US010363560B1

(12) United States Patent
Charette et al.

(10) Patent No.: US 10,363,560 B1
(45) **Date of Patent: *Jul. 30, 2019**

(54) SYSTEM AND METHODS OF PRESERVING INTEGRITY AND SECURELY TRANSPORTING BIOLOGICAL SPECIMENS TO A DEPOSITORY AND DEVICES FOR SECURELY STORING BIOLOGICAL SPECIMENS

(71) Applicants: Keith Charette, Westport, CT (US); Lynn Nordyk, Monroe, CT (US); Karen C. Paolella, Guilford, CT (US)

(72) Inventors: Keith Charette, Westport, CT (US); Lynn Nordyk, Monroe, CT (US); Karen C. Paolella, Guilford, CT (US)

( * ) Notice: Subject to any disclaimer, the term of this patent is extended or adjusted under 35 U.S.C. 154(b) by 320 days.

This patent is subject to a terminal disclaimer.

(21) Appl. No.: 15/409,324

(22) Filed: Jan. 18, 2017

Related U.S. Application Data

(60) Division of application No. 14/599,610, filed on Jan. 19, 2015, now Pat. No. 9,554,646, which is a continuation-in-part of application No. 13/565,244, filed on Aug. 2, 2012, now abandoned.

(60) Provisional application No. 61/574,442, filed on Aug. 3, 2011.

(51) Int. Cl.
*B01L 3/00* (2006.01)
*A47G 29/30* (2006.01)

(52) U.S. Cl.
CPC ..... *B01L 3/508* (2013.01); *A47G 29/30* (2013.01); *B01L 3/50853* (2013.01); *B01L 2300/023* (2013.01)

(58) Field of Classification Search
CPC ..... A47B 81/00; E05B 39/005; E05B 65/00; B01L 3/508; B01L 3/50853; B01L 2300/04; B01L 2300/023; A47G 29/1214; A47G 29/122; A47G 29/1225; A47G 29/124; A47G 29/141; A47G 29/16; A47G 29/20; A47G 29/30; A47G 2029/1221; A47G 2029/1226; A47G 2029/142; A47G 2029/147–149; A61L 2/10
USPC ..... 232/17, 19, 20, 27, 30–32, 34–37, 43.2, 232/44, 45; 340/545.6, 568.1, 569, 5.73; 312/209; 422/24
See application file for complete search history.

(56) References Cited

U.S. PATENT DOCUMENTS

| | | | | |
|---|---|---|---|---|
| 120,578 | A | 11/1871 | Farrington | |
| 4,576,281 | A | 3/1986 | Kirksey | |
| 5,774,053 | A | 6/1998 | Porter | |
| 5,818,336 | A | 10/1998 | Varga et al. | |
| 6,299,061 | B1 | 10/2001 | Henson | |
| 6,323,782 | B1 * | 11/2001 | Stephens | G07C 9/00103 340/10.31 |
| 6,483,433 | B2 * | 11/2002 | Moskowitz | A47G 29/141 232/34 |
| 6,612,489 | B2 * | 9/2003 | McCormick | A47G 29/10 235/382 |
| 6,679,419 | B1 * | 1/2004 | Sarracino | A47G 29/1207 232/17 |
| 6,742,703 | B2 | 6/2004 | Esakov et al. | |

(Continued)

*Primary Examiner* — William L Miller
(74) *Attorney, Agent, or Firm* — Kenneth F. Pearce

(57) ABSTRACT

A system and methods of securely storing biological samples prior to the secure transportation of the biological and/or biohazardous specimens to a depository where the system can determine the locations and pickup times of the couriers transporting the enclosures from the storage unit to the depository.

22 Claims, 9 Drawing Sheets

(56) References Cited

U.S. PATENT DOCUMENTS 6,766,605 B2 * 7/2004 Emert ..... G09F 13/22 232/30
6,779,714 B2 * 8/2004 Webb ..... A47G 29/1209 232/17
6,967,575 B1 11/2005 Dohrmann et al.
7,191,932 B2 * 3/2007 Fobbe ..... A47G 29/141 232/19
7,249,705 B2 * 7/2007 Dudley ..... A47G 29/141 232/45
7,256,691 B2 8/2007 Awobue
7,337,944 B2 * 3/2008 Devar ..... A47G 29/141 232/19
7,357,296 B2 * 4/2008 Stemmle ..... A47G 29/12 232/17
7,640,769 B1 1/2010 Clark
7,694,873 B1 * 4/2010 Jones ..... A61L 2/10 222/52
7,854,374 B2 * 12/2010 Dudley ..... A47G 29/12095 232/45
7,913,898 B2 * 3/2011 Frankenberg ..... A47G 29/22 160/36
9,913,555 B2 * 3/2018 Galluzzi ..... A47G 29/1214
2002/0125998 A1 9/2002 Petite et al.
2003/0085266 A1 * 5/2003 Simon ..... A47G 29/1207 232/27
2003/0127506 A1 * 7/2003 Braun, Jr. ..... A61L 2/10 232/31
2003/0150905 A1 * 8/2003 Mazzilli ..... A47G 29/1209 232/17
2003/0161757 A1 * 8/2003 Evans ..... A61L 2/08 422/22
2004/0140347 A1 * 7/2004 Mihaylov ..... A47G 29/1212 232/31
2006/0113368 A1 6/2006 Dudley
2008/0067227 A1 3/2008 Poss et al.
2009/0280035 A1 * 11/2009 Koudymov ..... A23L 3/28 422/108
2010/0012147 A1 * 1/2010 Lu ..... A61L 2/10 134/1
2014/0060095 A1 * 3/2014 Shur ..... A61L 2/10 62/129
2014/0061509 A1 * 3/2014 Shur ..... A23L 3/003 250/492.1
2016/0058020 A1 * 3/2016 Shur ..... A61L 2/10 99/451

* cited by examiner

SYSTEM AND METHODS OF PRESERVING INTEGRITY AND SECURELY TRANSPORTING BIOLOGICAL SPECIMENS TO A DEPOSITORY AND DEVICES FOR SECURELY STORING BIOLOGICAL SPECIMENS

This Divisional Application claims priority to Continuation-In-Part Application for Letters Patent entitled—System and Methods of Preserving Integrity and Securely Transporting Biological Specimens to a Depository and Devices for Securely Storing Biological Specimens; Ser. No. 14/599,610; filed Jan. 19, 2015 that claimed priority to Continuation-in-Part Application entitled "System and Methods of Preserving Integrity and Securely Transporting Biological Specimens to a Depository and Devices for Securely Storing Biological Specimens", Ser. No. 13/565,244, filed on Aug. 2, 2012, now abandoned, that claimed priority to Provisional Application entitled "Method of Preserving Integrity and Securely Transporting Biological Samples to a Laboratory and Devices for Securely Storing Biological Samples," Ser. No. 61/574,442, filed on Aug. 3, 2011, now expired, and pursuant to Title 35 of the United States Code, Applicants claim all rights flowing therefrom.

BACKGROUND OF THE INVENTION

1. Field of the Invention

Among other things, the present invention includes a system and methods and devices for securely storing biological samples prior to the secure transportation of the biological and/or biohazardous specimens to a depository. Within the scope of the present system and method, enclosures for securely enclosing the biological and/or biohazardous specimens in accordance with national, state and local safe handling standards for said biological specimens are supplied to specimen handlers. The current system and methods are capable of determining the locations and pickup times of the couriers transporting the enclosures from the storage unit to the depository.

2. Description of the Previous Art

1) U.S. Pat. No. 4,576,281—Kirksey enables a disposable syringe needle separation and storage box. The Description of the Preferred Embodiment, in part, reads, "In that respect, the present invention is directed to a separated syringe needle storage enclosure or box for facilitating the disposal of such needles after separation from the syringe barrel with such enclosure having means for facilitating the separation thereof. Further, it should be appreciated that certain components of the enclosure and disposal elements have counterparts in the referred to prior art apparatus. The improved, vertically upright, syringe needle storage enclosure box for facilitating the disposal of such separated needles, is indicated generally at 22. The vertically upright, outer box may be formed of steel although the illustrated box is of wood. In that respect, the enclosure 22 includes a top wall 24, a bottom wall 26, laterally opposed sidewalls 28 and 30, a rear wall 32 and a front opening door 34. The door 34 is mounted to the right sidewall 30 by way of a continuous hinge 36, the hinge 36 being appropriately screwed to the end of sidewall 30 and to the end of the door 34 by means of wood screws 38. Rubber grommets at 40 are fixedly mounted to the lower surface of the bottom wall 26 to permit the enclosure 22 to stand upright on the surface of a desk, cabinet or the like.

Enclosure 22 is essentially identical to the cited prior art outer enclosure, and may be made of steel or other sheet metal in the manner of the prior art structures, if desired.

Additionally, the top wall 24 is provided with a circular opening or hole 42. Unlike the prior art, instead of a basin or dish bearing a plastic bag functioning as the inner container for receiving separated disposable syringe needles or needle assemblies, which are gravity dropped into such container, the present invention employs a molded plastic jar indicated generally at 44 which is of a diameter approximating the width of the enclosure 22, and enclosure 22 may be square in cross-section. Further, the height of the jar 44 is such that it does not reach to the top wall 24 of the outer enclosure 22. The plastic jar 44 is necked down at its upper end as at 44a, terminating in a reduced diameter throat or rim 44b, which throat or rim 44b is threaded on its outer surface as at 46. As such, when a sufficient quantity of needle assemblies 16 accumulate within the jar 44, the door 34 may be unlocked, the jar 44 removed, and a cap (not shown) threaded to the top of the jar. The cap may be metal or plastic but should be sufficiently strong to prevent the sharp point 20a of the metal needle 20 from penetrating through the wall of the plastic jar 44 or its cap (not shown)."

Based on the current record, among other things, it does not appear that Kirksey teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Kirksey does not teach or disclose the utilization of an operations center, a network or a storage unit with electronic components capable of intercommunication with the operations center via the network.

2) U.S. Pat. No. 5,818,336—Varga, et al. enables a drop box inventory monitoring and control system. The Description of the Preferred Embodiment, in part, reads, "Referring now to the drawings, wherein like characters designate like or corresponding parts throughout the several views, there is shown in FIG. 1 an inventory monitoring and control system 100 according a preferred embodiment of the present invention. System 100 includes a drop sensor 200 cooperatively coupled for communication through a network modem 300. The drop sensor 200, network modem 300 and a door switch 400 are each powered for operation by an AC/DC power supply 500. Any network, such as a network radio modem or a public service telephone modem, may be used as network modem 300 In such a manner, system 100 can monitor and control inventories contained, for example, within a drop box 800, 850 as shown in FIGS. 2 and 3. In a first embodiment, the drop sensor 200 passively detects the passage of packages into the drop box 800, 850, as more fully described below. In a second embodiment, the drop sensor 200 actively detects packages, such as the physical detection of packages by switches, such as a paddle switch. The door switch 400 senses that the courier has opened a locked access door (not shown) of drop box 800, 850 to pick-up packages and commands the network modem 300 to transmit a message that the packages have been picked up.

With reference first to the embodiment shown in FIG. 2, the drop sensor 200 is positioned within drop box 800 of the type having a first door 810 through which a patron deposits a package P. Attached to the first door 810 is an extension 820 which generally propels the package P into a downward trajectory within the drop box 800. Drop sensor 200 is, thus, positioned within the drop box 800 such that its sensing field F is generally parallel to the floor 830 of drop box 800. In a conventional manner, drop box 800 includes a second, courier door 840 for removal of the packages P deposited therein.

Drop box 850, as shown in FIG. 3, also includes a first door 810 which is adapted for receiving packages P deposited by a patron, and a second door 840 which permits the courier to remove those packages P deposited within drop box 850. It should be readily apparent from FIG. 3 that the first door 810 of drop box 850 does not include an extension 820 as does its counterpart drop box 800. In such cases, packages P may not break the sensing field F of the drop sensor 200 if positioned as shown in FIG. 2. Accordingly, the drop sensor 200 shown in FIG. 3 is positioned optimally to project its sensing field F downwardly across the drop box 850 so that, in the unlikely event that a package P falls in a generally parallel position with respect to the floor 830, such package P will nevertheless be sensed by the drop sensor 200. In accordance with a presently preferred embodiment of the invention, drop sensors 200 deployed within drop boxes 850 of the type shown in FIG. 3 should be positioned such that their sensing field F is approximately 35° below a line which is parallel to the floor 830 of those drop boxes 850."

Based on the current record, among other things, it does not appear that Varga teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Varga does not teach or disclose the utilization of a storage unit communications module capable of intercommunication with multiple storage unit hardware components, where the communications module can send/receive data with a network.

3) U.S. Pat. No. 7,640,769—Clark enables a portable self-contained storage apparatus for biologicals. The Detailed Description of Invention, in part, reads, "FIG. 2 is a front cross-sectional view of a first embodiment of the invention (vertical section II-II' or VI-VI'—see FIGS. 1 and 5). Cabinet 1 contains a thermally-insulated box 20, which is subdivided into an upper (freezer) compartment 21 and a main (chilled) compartment 22. The two subdivisions are insulated from each other by an insulated barrier 24. Below the box 20 is a power compartment 25 containing a battery pack 26 and a compressor 27 along with electronic regulating circuitry. High-efficiency insulation 204 (e.g., rigid foam) is interposed between box 20, cabinet 1, and power compartment 25. Also visible in this view are lifting handles 6 and feet 7. Both the freezer compartment 21 and the chilled compartment 22 contain one or more tray support racks 28. (In the depicted embodiment, the freezer compartment 21 contains two such racks, and the chilled compartment 22 contains four such racks). Each rack 28 supports a plurality of elongate trays 201 (in the depicted embodiment, five) extending from the front of the box to the back. The trays 201 are of a width to accommodate the long dimension of a standard vial box 203 (shown in dashed lines to indicate environmental structure)."

Based on the current record, among other things, it does not appear that Clark teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Clark does not teach or disclose the utilization of an operations center, a network or a storage unit with electronic components capable of intercommunication with the operations center via the network.

4) US Patent 20020125998—Petite, et al., discloses a system and method for monitoring and controlling remote devices. The Summary of the Invention, in part, reads, "[0014] In accordance with a broad aspect of the invention, a system is provided having one or more sensors to be read and/or actuators to be controlled remotely, ultimately through a computer on the Internet. The sensors and/or actuators are interfaced with wireless transceivers that transmit and/or receive data to and from the Internet. In this regard, additional wireless transceivers may relay information between the transceivers disposed in connection with the sensors and actuators and a gateway to the Internet. It should be appreciated that, a portion of the information communicated includes data that uniquely identifies the sensors and/or actuators.

[0015] In accordance with one aspect of the invention, a system is configured to monitor and report system parameters. The system is implemented by using a plurality of wireless transceivers. At least one wireless transceiver is interfaced with a sensor, transducer, actuator or some other device associated with the application parameter of interest. In this regard, the term "parameter" is broadly construed and may include, but is not limited to, a system alarm condition, a system process variable, an operational condition, etc. The system also includes a plurality of transceivers that act as signal repeaters that are dispersed throughout the nearby geographic region at defined locations. By defined locations, it is meant only that the location of each transceiver is known to a central computer. The central computer may be informed of transceiver physical locations after permanent installation, as the installation location of the transceivers is not limited. Each transceiver that serves to repeat a previously generated data signal may be further integrated with its own unique sensor or a sensor actuator combination as required. Additional transceivers may be configured as stand-alone devices that serve to simply receive, format, and further transmit system data signals. Further, the system includes a local data formatter that is configured to receive information communicated from the transceivers, format the data, and forward the data via the gateway to one or more servers interconnected with the WAN. The server further includes means for evaluating the received information and identifying the system parameter and the originating location of the parameter. The server also includes means for updating a database or further processing the reported parameters.

[0016] Consistent with the broader concepts of the invention, the "means" for evaluating the received information and the "means" for reporting system parameters are not limited to a particular embodiment or configuration. Preferably, these "means" will be implemented in software that is executed by a processor within a server integrated with the Internet. However, dedicated WANs or Intranets are suitable backbones for implementing defined system data transfer functions consistent with the invention."

Based on the current record, among other things, it does not appear that Petite teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Petite does not teach or disclose the utilization of a storage unit communications module capable of intercommunication with multiple storage unit hardware components, where the communications module can send/receive data with a network.

5) U.S. Pat. No. 6,299,061—Henson enables a security mailbox. The Description of the Preferred Embodiment, in part, reads, "As a first embodiment of the security mailbox 10, the means for closing access to the compartment 11 through the slot 18 includes a revolving door member 22 conventionally mounted inside the container 11 and having a shaft 23 rotatably and conventionally mounted to the side walls 13, 14 proximate to the slot 18, and further has a plurality of door members 24-27 having ends securely and conventionally attached to the shaft 23 for rotation therewith and extending radially therefrom. The door members 24-27 are adapted to close access to the compartment 11 between themselves and the front wall 17 at the slot 18, one of the door members 27 having an outer end which has a weighted member 31 securely attached thereto for placing the door members 24-27 in a closed position."

Based on the current record, among other things, it does not appear that Henson teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for said biological specimens. Further, Henson does not teach or disclose the utilization of an operations center, a network or a storage unit with electronic components capable of intercommunication with the operations center via the network.

6) U.S. Pat. No. 120,578—Farrington enables an improvement in letter boxes. Page 1 of Farrington reads, "One edge of each of these shelves is rigidly secure, longitudinally, to a horizontal shaft, E, the other edge is free to move by the weight of the newspaper when dropped upon it. F is a curved guard, fitted to the line of motion of the outer edges of the revolving shelves . . . upon which said guard the paper are deposited by the revolving shelves . . . ."

Based on the current record, among other things, it does not appear that Farrington teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Farrington does not teach or disclose the utilization of an operations center, a network or a storage unit with electronic components capable of intercommunication with the operations center via the network.

7) U.S. Pat. No. 6,742,703—Esakov, et al., enables a mail collection box. The Detailed Description of the Invention, in part, reads, "A deposit door 120 may be supported by housing 102, for example pivotally supported by one or more hinges mounted to housing 102, so that the deposit door is moveable from a deposit door open position 122 (FIGS. 1, 4-5, 8), which provides access to the housing interior space 104 through mail deposit opening 118, and a deposit door closed position 124 (FIGS. 2-4), in which the perimeter 126 of deposit door 120 engages housing 102. Deposit door 120 may include a deposit opening gasket 176 proximate perimeter 126—and/or housing 102 may include deposit opening gasket 176 surrounding mail deposit opening 118—to facilitate a seal between the deposit door and the housing in the deposit door closed position 124. The quality and type of seal may be that of any of the seals described below. Deposit door locking mechanism 142 is positioned to interact between the deposit door 120 and housing 102 so that the deposit door 102 may be locked in the deposit door closed position 124. Portions of locking mechanism 142 may be mounted to housing 102, deposit door 120, or both. Suitable locking mechanisms are known in the art."

Based on the current record, among other things, it does not appear that Esakov teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Esakov does not teach or disclose the utilization of an operations center, a network or a storage unit with electronic components capable of intercommunication with the operations center via the network.

8) US Patent 20060113368—Dudley discloses a theft preventative mailbox having remote unlocking activation mechanism. The Detailed Description of Preferred Embodiments, in part, reads, "The trap door mechanism 203 can be implemented in a variety of ways. The trap door mechanism 203 can be in a default closed position so that outgoing mail can be placed into the main compartment 101 at any time. Alternatively, the trap door mechanism 203 can have the trap door(s) 201 in the default open position, with the trap door(s) 201 movable to the closed position by the addressee if the addressee desires to place outgoing mail in the main compartment 101. In either case, the trap door(s) 201 are adaptable to retain outgoing mail in the main compartment 101 and permit incoming mail to eventually fall into the secure drop box compartment 202. Although two trap door mechanisms are described below, there are a variety of different trap door mechanisms that can be used in the various embodiments of the present invention, all of which are covered by this present invention. The trap door(s) 201 can be comprised of a single door or it can be comprised of multiple trap doors, such as two halves that open in the center, such trap door(s) 201 and being hinge-ably coupled proximate the top of the secure drop box compartment 202. A first trap door mechanism 203 includes a release button or disc that is manually operated. The default position of the trap door(s) 201 is the closed position. When the postal employee inserts any new mail into the main compartment 101 and presses the release button or disc, the trap door(s) open and drop the incoming mail into the secure drop box compartment 202. The release button or disc and trap door(s) 201 can further be coupled to a mechanical or electronic time delay mechanism such that after the mail is deposited, the trap door(s) 201 automatically close after a predetermined amount of time. When the postal employee closes the front mailbox door 102, the locking and unlocking mechanism 103 is adapted to automatically lock.

A second trap door mechanism can be coupled to the unlocking activation means 104 such that after a certain amount of time after the unlocking activation means 104 is activated by the postal employee using a specially encoded signal, and the front mailbox door 102 is opened, the trap door(s) 201 automatically open, thus dropping any items placed in the main compartment 101 into the secure drop box compartment 202. The default position of the trap door(s) 201 that use this second trap door mechanism is the closed position. After a further amount of time as determined by a mechanical or electronic timing mechanism, the trap door(s) 201 close.

Once packages and mail have fallen into the secure drop box compartment 202, the trap door(s) 201 return to the closed position leaving the incoming mail in the secure drop box compartment 202 until the addressee retrieves the mail by opening at least one drop box door 204 located on the backside of the mailbox.

The drop box door(s) 204 is hinge-ably connected to the secure drop box compartment 202 and is adapted to allow access into the secure drop box compartment 202. The drop box door(s) 204 includes a drop box door lock mechanism 205 that is secured by a key lock or is integral with the card key system 400, FOB system 500 or RFID system 600 unlocking activation mechanism 104 described herein. The drop box door(s) 204 can only be unlocked using the addressee's specific key, card key, FOB transmitter, RFID reader or override key. In the card key system, a contact reader can be used which comprises a slot located on the backside of the mailbox. When the addressee closes the drop box door(s) 204, the drop box lock mechanism 205 is adapted to automatically lock.

In a first embodiment of the present invention, a curbside mailbox with an unlocking activation mechanism 104 that is activated using a card key system 400 is provided. As seen in FIG. 4, the unlocking activation mechanism 104 can be comprised of a card key system 400 having a master coded card 401A, a subordinate card 401B retained by the addressee and a card reader 402, the card reader 402 being located at the mailbox and being coupled to the locking and unlocking mechanism 103. The card reader 402 would have a power source which can be the AC mains, a non-rechargeable or rechargeable DC battery source or a DC solar power source which is operable to power the card reader 402 directly or to recharge the rechargeable batteries. Card key systems can comprise a variety of technologies, such as contact, contactless (proximity), passive, active, magnetic, electronic, sonar and optical. Each of such implementation technologies is included within the purview of this invention."

Based on the current record, among other things, it does not appear that Dudley teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Dudley does not teach or disclose the utilization of an operations center, a network or a storage unit with electronic components capable of intercommunication with the operations center via the network.

9) US Published Patent Application 20080067227—Poss, et al. discloses an electrically-powered programmable package deposit enclosure. The Detailed Description, in part, reads, "FIG. 1 provides a perspective view detailing outer container 24, insertion door 22, Envelopes and Mailers door 21, Envelopes and Mailers shelves 20, Package Removal Door 26, showing the relationship between the doors and compartments according to this embodiment of the present invention. A photovoltaic (PV) cell array 32 is mounted on top of the unit, covering part of it. In one embodiment, cells 32 produce enough power for the average number of 15 data logging events and wireless data transmissions per day. The battery 36, shown in FIG. 2, has enough energy storage to provide for usage through several weeks of intermittent sunlight, to provide adequate reserve power for periods of bad weather. The cells are wired to the energy storage system, which stores power to drive the sensors and Programmable Logic Controller PLC 44. Status indicator lamps 60, FIGS. 3 and 4, provide visual means of displaying information such as a system malfunction or to indicate the level of bin capacity used and available or other notices, such as "low battery," "bin collected," "envelopes empty," "device broken," or other messages. An insertion door 22 acts to prevent unauthorized use because it can lock out the user from the insertion door. In one embodiment, the insertion door lock is opened when it receives a message from PLC 44. In this embodiment, PLC will send a message to open the insertion door when it receives input from a Barcode Scanner 68, FIG. 4. This input may be given when, for example, a package with the appropriate Bar Code is placed in front of the scanner and the "ON Button," 67 in FIG. 4, is pressed by the user. In an alternative embodiment, the device is turned on when the Insertion Door 22 is opened or when the ON Button is pressed."

Based on the current record, among other things, it does not appear that Poss teaches or discloses an ultraviolet light irradiating, for a predetermined time, the storage unit to reduce microbial growth.

10) U.S. Pat. No. 5,774,053—Porter enables a storage device for the delivery and pickup of goods. The Detailed Description of the Preferred Embodiments, in part, reads, "As best illustrated in FIG. 3, the enclosure 14 includes a front hinged door 18 for permitting access to the front of the enclosure 14 and may include a rear hinged door 20 for permitting the homeowner to retrieve goods from or place goods in the rear of the enclosure 14. In the first embodiment of the storage device 10 illustrated in FIG. 1, the rear hinged door 20 may extend through an exterior wall of the home 12 so that the homeowner can access the storage device 10 while inside the home 12."

Based on the current record, among other things, it does not appear that Porter teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Porter does not teach or disclose the utilization of an operations center, a network or a storage unit with electronic components capable of intercommunication with the operations center via the network.

11) U.S. Pat. No. 6,967,575—Dohrmann, et al. enables methods and apparatus for unattended pickups and deliveries. The Detailed Description, in part, reads, "FIG. 2 is a perspective view of a secure pickup and delivery container 202, in accordance with one embodiment of the invention. Secure container 202 includes a lockable door 204 that can include a handle 206. In one embodiment door 204 is coupled to secure container 202 by means of suitable hinges 208. Door 204 allows access to an interior part of the secure container 202. Other types of doors besides hinged doors could be used, such as sliding, shuttered, or revolving doors. Secure container 202 includes an access element 210 that can be implemented in a variety of ways, such as with a token or card slot 212 or a keypad, as described further below. A delivery person must present access request information to access element 210 that matches stored access privilege information in order to gain physical access to secure container 202."

Based on the current record, among other things, it does not appear that Dohrmann teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Dohrmann does not teach or disclose the utilization of an operations center, a network or a storage unit with electronic components capable of intercommunication with the operations center via the network.

12) U.S. Pat. No. 7,256,691—Awobue enables a smart mailbox. The Brief Description of the Preferred Embodiments, in part, reads, "The mailbox 10 is provided with an upper lid 18 movably attached through the hinges 102 (visible in FIG. 2) to the back panel of the mailbox. An upper keyhole 20 positioned on a front panel of the lid 18. A detailed diagram of the keyhole 20 and associated locking system is shown in FIG. 4. The mailbox further comprises a keypad 22 for electronically locking and opening the door, a front door keyhole 24 providing options for mechanically and electronically locking and opening door, and indicators 26 for indicating receipt of mail in the box 12."

Based on the current record, among other things, it does not appear that Awobue teaches or discloses a storage unit with a lower section and an upper section, where the upper section includes a deposit-only gate for receiving deposits of enclosures that enclose biological specimens such that after deposit onto and closure of the deposit-only gate the enclosures drop into a portable insulated holder positioned in the lower section of the storage unit until removal of the enclosures is authorized, and where the deposited enclosures are in accordance with national, state and local safe handling standards for the biological specimens. Further, Awobue does not teach or disclose the utilization of an operations center, a network or a storage unit with electronic components capable of intercommunication with the operations center via the network.

SUMMARY OF THE INVENTION

Unlike prior art methods for securely transporting biological samples to a depository, the current system and methods utilize a novel and nonobvious secure storage unit for storing the biological samples or specimens until an authorized courier transports the biological samples to the depository. Within the scope of the present system and method, enclosures for securely enclosing the biological specimens in accordance with national, state and local safe handling standards for said biological specimens are supplied to specimen handlers. The unique storage units of the current invention are positioned in proximity to the specimen handlers and the specimen handlers can deposit the secure enclosures enclosing biological samples into one or more storage units. Applicants' system and methods meet the long felt but unfulfilled need of providing secure storage of biological specimens prior to the transporting of the biological specimens to the depository. Further, use of the current system and methods can also meet the long felt but unfulfilled need of determining the locations and pickup times of the couriers transporting the enclosures from the storage unit to the depository. Further still, use of the current system and methods can also meet the additional long felt but unfulfilled need of an operations center intercommunicating with storage units remote from the operation center, where the operations center can control the operation of one or more of the storage units.

An aspect of the present system and methods is to provide cost efficient insulated enclosures for securely containing biological samples.

Still another aspect of the present system and methods is to provide a storage unit with a deposit-only gate or opening for receiving deposited enclosures containing biological samples.

It is another aspect of the present system and methods to provide a storage unit that can be divided into upper and lower sections.

Yet another aspect of the present system and methods is to provide a portable insulated holder for holding the enclosures deposited into the storage unit.

Still another aspect of the present system and methods is to provide a door and lock combination for securing access to the lower section of the storage unit.

It is another aspect of the present system and methods to provide a storage unit, network and an operations center remote from the storage unit where the storage unit and the operations center can intercommunicate with each other.

Yet another aspect of the present system and methods is to provide storage unit that can utilize a CPU or a communications module to intercommunicate with one or more hardware components of the storage unit and a network.

Still another aspect of the present system and methods allows the operations center to monitor the status of the storage units remote from the operations center.

It is still another aspect of the present system and methods that allows the operations center to control operations of one or more storage units remote from the operations center.

A preferred embodiment of the present invention can be described as a system for holding temporarily and thereafter transporting biological samples to a depository for subsequent analysis of the biological specimens by said depository; the system comprising: I) enclosures securely enclosing and preserving integrity of the biological specimens until the analysis of the biological specimens by the depository; II) at least one storage unit for temporarily holding the biological samples comprising: a) a lower section and an upper section, wherein the upper section comprises a pivotable deposit-only gate for receiving deposits of the enclosures such that after deposit into/onto and closure of the pivotable deposit-only gate, the enclosures drop into a portable holder until removal of the enclosures is authorized; b) a door and lock combination allowing removal of the enclosures from the storage unit; c) a CPU or a communications module capable of sending/receiving data with: i) one or more hardware components of the storage unit; and ii) a network remote from the storage unit; d) an antenna; e) an energy source; and f) an ultraviolet light positioned within storage unit, wherein, when the lower section is emptied of deposited enclosures, the ultraviolet light is activated, for a predetermined time, to reduce microbial growth; and III) an operations center, remote from the storage unit in communication with the storage unit via the network.

Another preferred embodiment of the present invention can be described as a system for preserving integrity, securely holding and transporting biological specimens to a depository; the system utilizing a plurality of storage units remote from an operations center, wherein said plurality of storage units are capable of intercommunication with at least one computing device remote from the storage units and under control of the operations center, and wherein each storage unit comprises: a) a deposit-only opening for receiving temporary deposits of enclosures containing the biological samples such that after deposit, the enclosures drop into a holder until removal of the enclosures is authorized; b) an ultraviolet light positioned within the storage unit, wherein, when the storage unit does not contain any of the enclosures, the ultraviolet light is activated, for a predetermined time, to reduce microbial growth; c) a door and lock combination allowing authorized removal of the enclosures from the storage unit; d) a communications module capable of intercommunicating with: i) one or more hardware components of the storage unit, wherein the hardware components comprise an enclosure detection sensor capable of detecting entry of the enclosures into the holder, an internal temperature sensor, an energy source status monitor, an open/close sensor for said door, a door opening signal receiver, an electrically actuated lock, a gate sensor for movement of the opening or a holder detector; and ii) via a network, said at least one computing device remote from the storage unit; f) an antenna; and g) an energy source.

Yet another preferred embodiment of the present invention can be described as a system for holding temporarily and thereafter transporting biological samples to a depository for subsequent analysis of said biological specimens by the depository; the system comprising: a) enclosures securely enclosing and preserving integrity of the biological specimens until the analysis of the biological specimens by the depository; and b) a plurality of storage units remote from an operations center intercommunicating with the operations center; each the storage unit comprising: i) a lower section and an upper section comprising a deposit-only gate for receiving deposits of the enclosures such that after deposit onto and closure of the deposit-only gate, the enclosures drop into an insulated holder positioned in the lower section until removal of the enclosures is authorized by the system's operation center in communication with at least one of the storage units; ii) an ultraviolet light positioned within the storage unit, wherein, when the storage unit does not contain any of the enclosures, the ultraviolet light is activated, for a predetermined time, to reduce microbial growth; and iii) an energy source.

Still another preferred embodiment of the present invention can be described as storage unit securely for holding one or more enclosures enclosing one or more biological specimens until the enclosures are removed from the storage unit for transport to a depository wherein subsequent analysis of the biological specimens can transpire; the storage unit comprising: a) a lower section and an upper section, wherein the upper section comprises a pivotable deposit-only gate for receiving deposits of the enclosures such that after deposit onto and closure of the pivotable deposit-only gate, the enclosures drop into a portable insulated holder positioned in the lower section until removal of the enclosures is authorized; b) an ultraviolet light having a wavelength of about 253 nanometers and positioned within the storage unit, wherein, when the lower section does not contain any of the enclosures, the ultraviolet light irradiates, for a predetermined time, the storage unit to reduce microbial growth within the storage unit; c) an energy source for the ultraviolet light; and d) a door and lock combination allowing removal of the enclosures by a courier from the storage unit.

It is the novel and unique interaction of these simple elements which creates the system, methods and apparatus, within the ambit of the present invention. Pursuant to Title 35 of the United States Code, descriptions of preferred embodiments follow. However, it is to be understood that the best mode or preferred descriptions do not limit the scope of the present invention.

DESCRIPTION OF THE PREFERRED EMBODIMENTS

Figure 1:
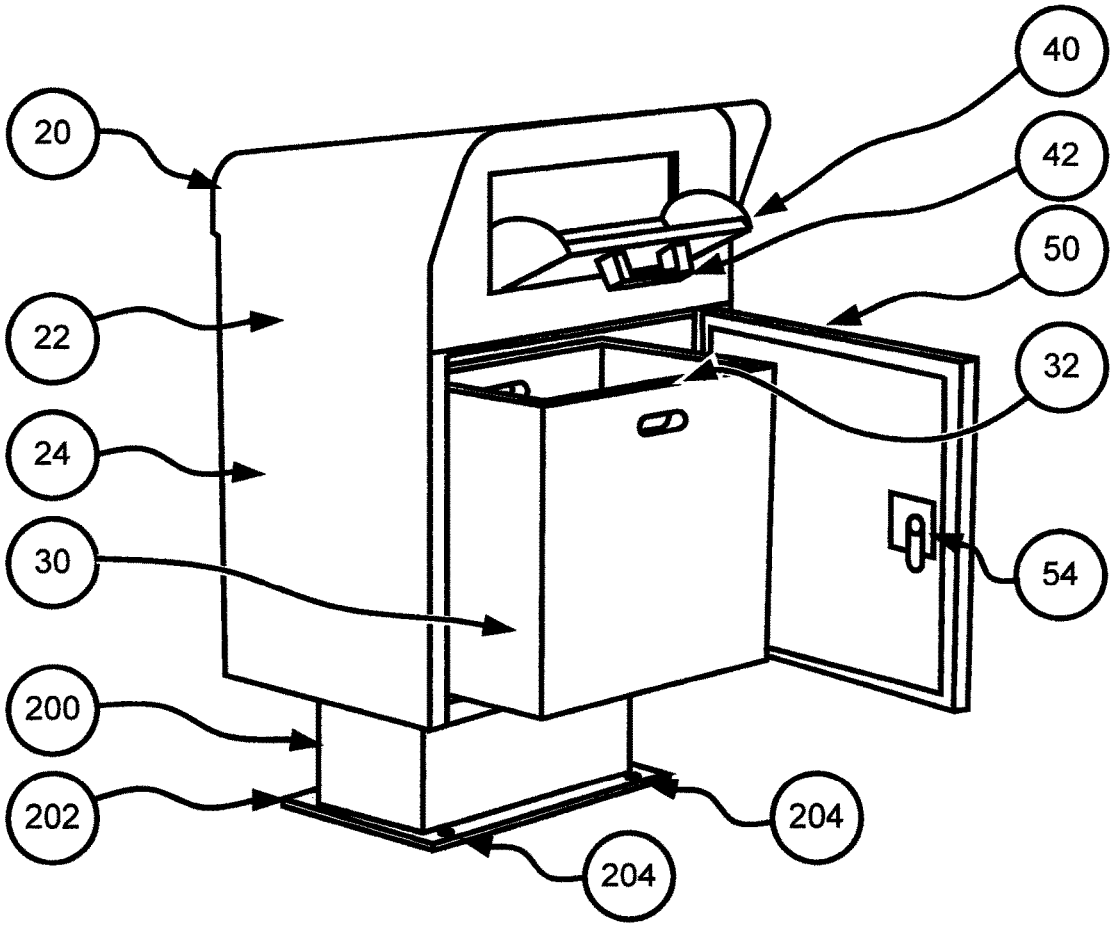
FIG. 1 is a lateral perspective of a preferred embodiment of storage unit and portable storage holder within the scope of the present invention.

The disclosure hereof is detailed to enable those skilled in the art to practice the invention, and the embodiments published herein merely exemplify the present system, methods and devices and do not limit the scope of the claims appended hereto.

The present system and method is directed primarily toward the preservation of integrity, secure storage and transportation of biological samples or specimens from a secure storage unit to a depository. Within the scope of the current invention, depositories include but are not limited to testing laboratories, storage facilities, cryonic facilities, blood banks or any other facility handling, storing or managing biological specimens or samples. Unique to the current system and method is the storage unit located on the premises proximate the biological specimen handlers. Examples of biological specimen handlers include but are not limited to any person licensed by or legally allowed by a government to handle biological specimens, e.g., medical doctors, nurses, hospital technicians, military technicians, law enforcement officers, emergency medical technicians, to identify a few of the many possible biological specimen handlers. Due to the possibility of breach of the integrity of the biological sample or the potential contamination of couriers and others within the scope of the present invention, prior to deposit into the storage unit, the biological samples are enclosed in enclosures that comply with national, state and local standards for transporting biological samples. By way of illustration, an example of a legal enclosure is a sealable plastic bag designed for enclosing tubes that carry biological samples where the plastic bags and the tubes meet the national, state and local standards for storing and transporting biological specimens or samples.

Select preferred embodiments of the present invention allow an operations center remote from one or more of the storage units to authorize one or more couriers to transport the enclosures to the depository. In other select preferred embodiments of the current system and method, an operations center remote from one or more of the storage units can utilize a network to monitor conditions, status and the environment of one or more of the secure storage units. Networked communications between the storage units and the operations center allow exchange or intercommunication of data between the storage units remote from the operations center and the operations center, thereby allowing the operations center the option to control one or more of the storage units remote from the operations center. Examples of networks that can be associated with the current invention include but are not limited to cellular, satellite, mobile infrastructure, wide area, local area, public and the infrastructure and clouds associated with the identified networks.

In select preferred embodiments of the current invention, directives initiated by the data exchanged between the storage units and the operations center can control movement and scheduled pickup times of the couriers that transport the enclosures containing the biological specimens to the depository.

In other select preferred embodiments of the current invention, an ultraviolet light located in the storage unit is used to reduce microbial growth within the storage unit.

FIG. 1 is a lateral perspective of a preferred embodiment of storage unit (20) and portable storage holder (30) within the scope of the present invention. Portable storage holder (30) can be provided with a layer (32) of insulation, e.g., thermal insulation. By way of illustration and not limitation, insulation layer (32) can be paper, foam or any other insulator acceptable in the art.

For select preferred embodiments of storage unit (20), storage unit (20) has an upper section (22) and lower section (24). Upper section (22) is provided with deposit-only gate (40) and lower section (24) is provided with door (50) and lock (54). As shown in FIG. 1, deposit-only gate (40) is pivotable between an opened and closed position and is provided with handle (42). When closed, deposit-only gate (40) and door (50) and lock (54) combination prevent access to deposited enclosures.

As shown in FIG. 1, storage container (20) is supported by riser (200) and base (202) combination where base (202) can be bolted to the floor with bolts (204). Although not shown, riser (200) can incorporate internal weights instead of bolts to stabilize riser (200). And although not shown in FIG. 1, in select preferred embodiments, storage container (20) can be provided with a vertical mounting bracket to mount storage container to a vertical support such as a wall, column or beam.

Figure 2:
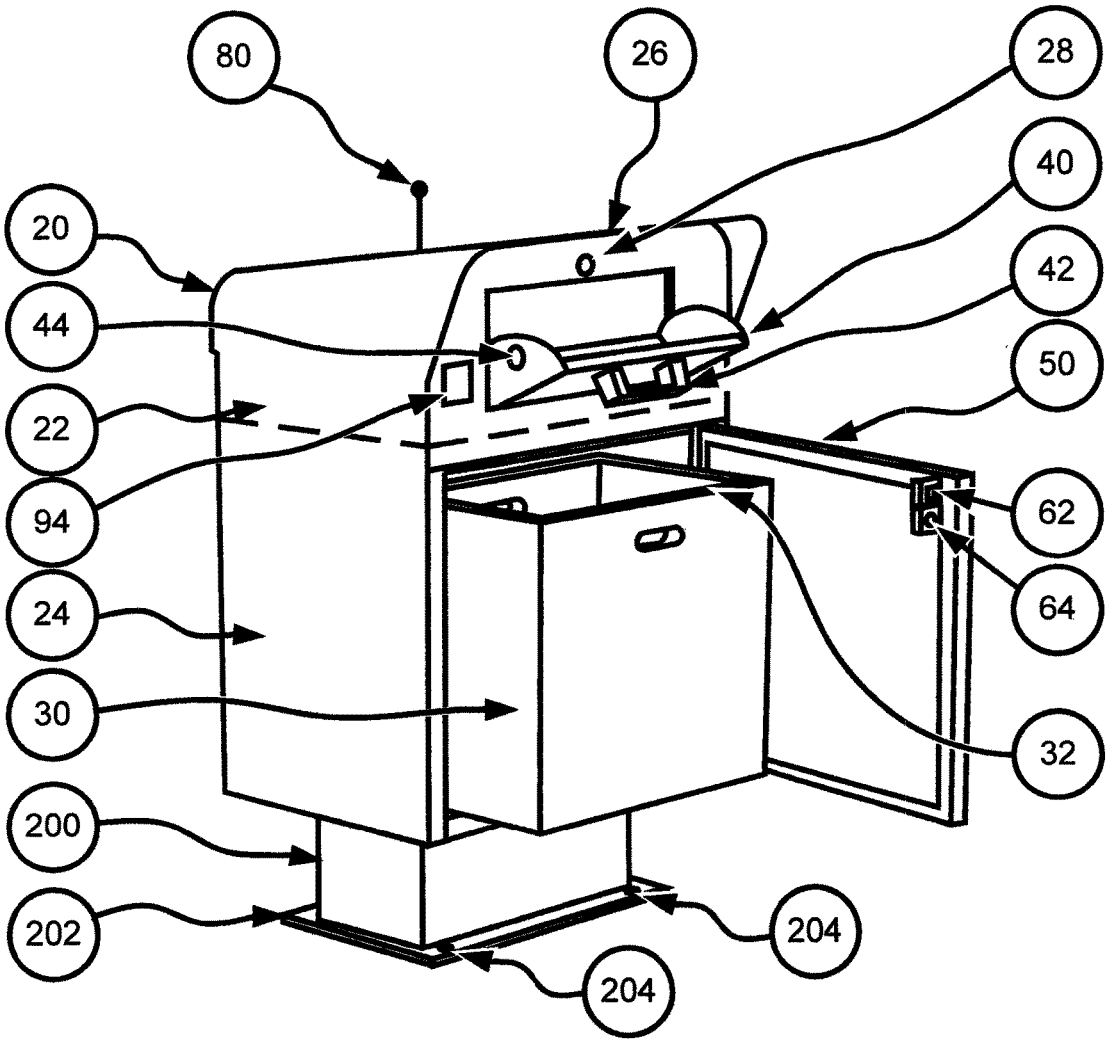
FIG. 2 is a lateral perspective of a preferred embodiment of another storage unit and holder within the scope of the present invention.

FIG. 2 is a lateral perspective of another preferred embodiment of storage unit (20) and portable holder (30) within the scope of the present invention. Select preferred embodiments of storage unit (20) can be provided with a permanent holder instead of a portable holder. Preferred embodiments of holders can include a layer (32) of insulation. By way of illustration and not limitation, layer (32) can be paper, foam or any other insulator acceptable in the art.

Figure 3:
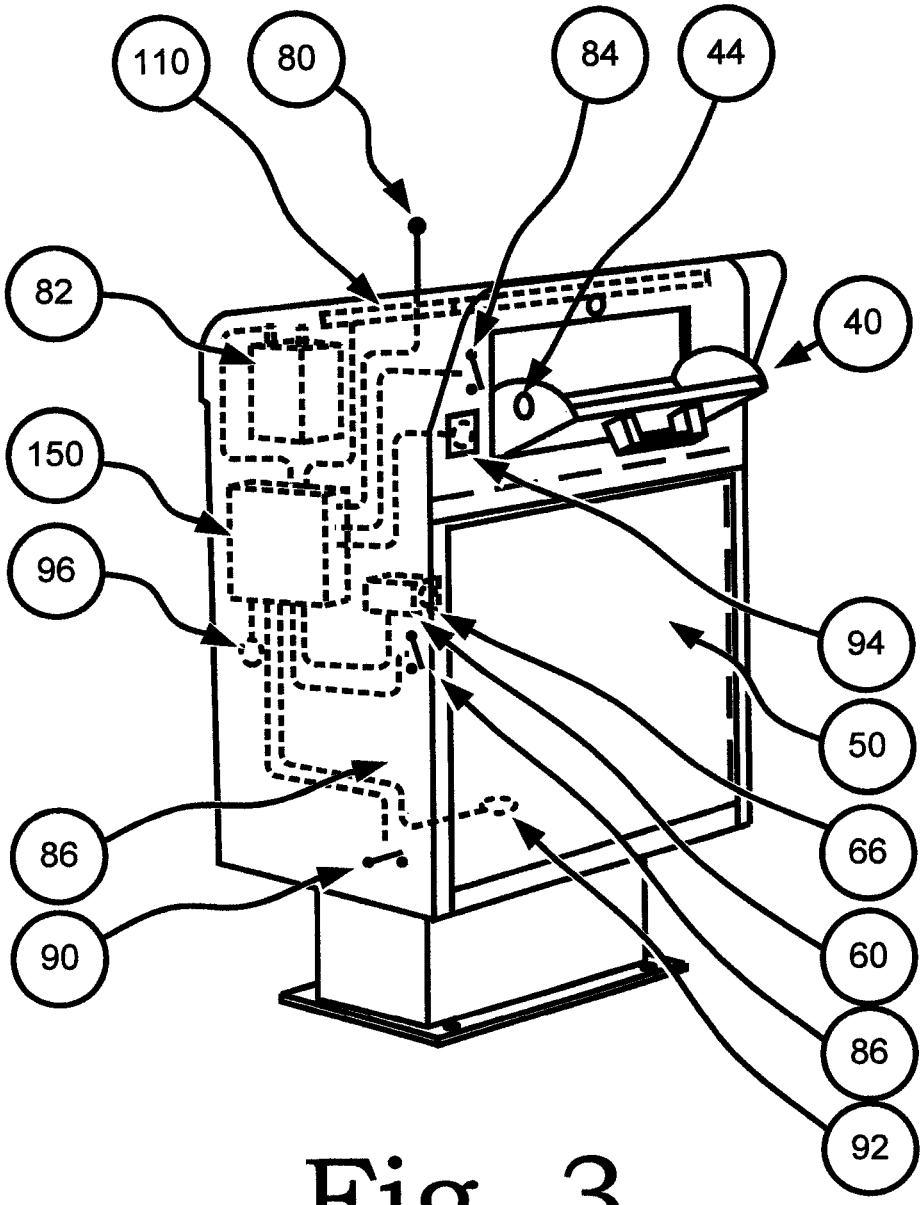
FIG. 3 is a lateral perspective of a preferred embodiment of the FIG. 2 storage unit with many of the storage unit's hardware components shown in phantom.

As shown in FIGS. 2-3, select preferred embodiments of storage unit (20) can be provided with deposit-only opening (40), door (50) and solenoid and lock (66) combination (60). As shown in FIGS. 1 and 3, gate or opening (40) is provided with handle (42) and magnet (44). When closed, deposit-only gate or opening (40) and door (50) and solenoid and lock (60) combination prevent access to the deposited enclosures. As shown in phantom in FIG. 2, storage unit (20) is divided into hinged upper section (22) and lower section (24). When required upper section's (22) security lock (28) can be unlocked and hinged upper section (22) pivoted about its hinges to expose storage unit's (20) hardware components and circuitry that will be described more specifically below. In FIG. 3, many of the storage unit's (20) hardware components and circuitry are shown in phantom.

In select preferred embodiments of the current invention, inward side of door (50) is provided with magnet (64) and lock receptacle (62) for receiving lock (66) of solenoid and lock combination (60). In the event of a hardware/software, power or communications network malfunction, can receive a device, e.g., as a key, for manually unlocking door (50). As shown in FIGS. 2 and 3, antenna (80) extends above top (26) of storage container (20) and intercommunicates with CPU/transceiver or communications module (150) by any means acceptable in the art. In other select preferred embodiments, antenna (80) can be positioned within storage unit (20).

Figure 2A:
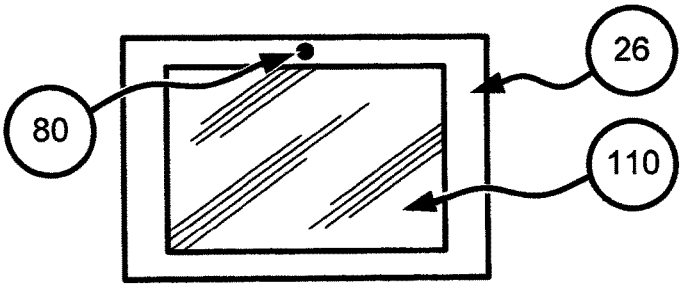
FIG. 2A is a plan of view of top (26) of a preferred embodiment of storage unit (20).

As shown in FIG. 3, energy source for storage unit (20) and its components is a direct current energy source (82), such as a battery. However, in other preferred embodiments, when engineering parameters require, the energy source for storage unit (20) can be alternating current that is converted to direct current to power CPU/transceiver or a communications module (150). As shown in FIGS. 2A and 3, select preferred embodiments of storage unit (20) are provided with photovoltaic panel (110) for supplying electrical energy to said direct current energy source (82).

Returning to FIGS. 2-3, proximate deposit-only gate (40) is a gate movement sensor (84) for detecting movement of deposit-only gate or opening (40). Proximate door (50) is door open/close sensor (86). By way of illustration and not limitation, those skilled in the art recognize that the combination of reed switches and magnets (44 and 64) can be utilized to create gate movement sensor (84) and door open/close sensor (86). Storage unit (20) can also be provided with holder detector (90) to detect the presence of portable holder (30).

Select preferred embodiments of the current invention are provided with an enclosure detection sensor (92) capable of detecting entry of enclosures into the permanent holder or portable holder (30) when the holder is locked inside the secure storage unit (20). Enclosure detection sensors (92) can include triboelectric, acoustic, electromagnetic, photoelectric, electromechanical, thermal gradient, piezoelectric, dielectric loss sensors or any other sensor acceptable in the art.

Within the scope of the present invention, storage units (20) can be provided with door opening signal receiver (94). By way of illustration and not limitation, a device such as an infrared key fob remote device, acoustic transmitter or a remote radiofrequency transmitter can be used by a person in proximity with the storage unit (20) to generate a door opening signal toward storage unit's (20) door opening signal receiver (94). Preferred embodiments of storage unit (20) are provided with internal temperature sensor (96).

Within the scope of the current invention, antenna (80), gate movement sensor (84), door open/close sensor (86), holder detector (90), enclosure detection sensor (92), door opening signal receiver (94), internal temperature sensor (96) and solenoid and lock combination (60) communicate/intercommunicate with CPU/transceiver or a communications module (150) by any means acceptable in the art. Select preferred embodiments of storage unit (20) include a CPU/transceiver or a communications module (150) that has an energy source status monitor. Within the scope of the current invention, communications module (150) can be any communications module acceptable in the art capable of communicating with hardware or software components of storage unit (20) and operations center (300).

Figure 4:
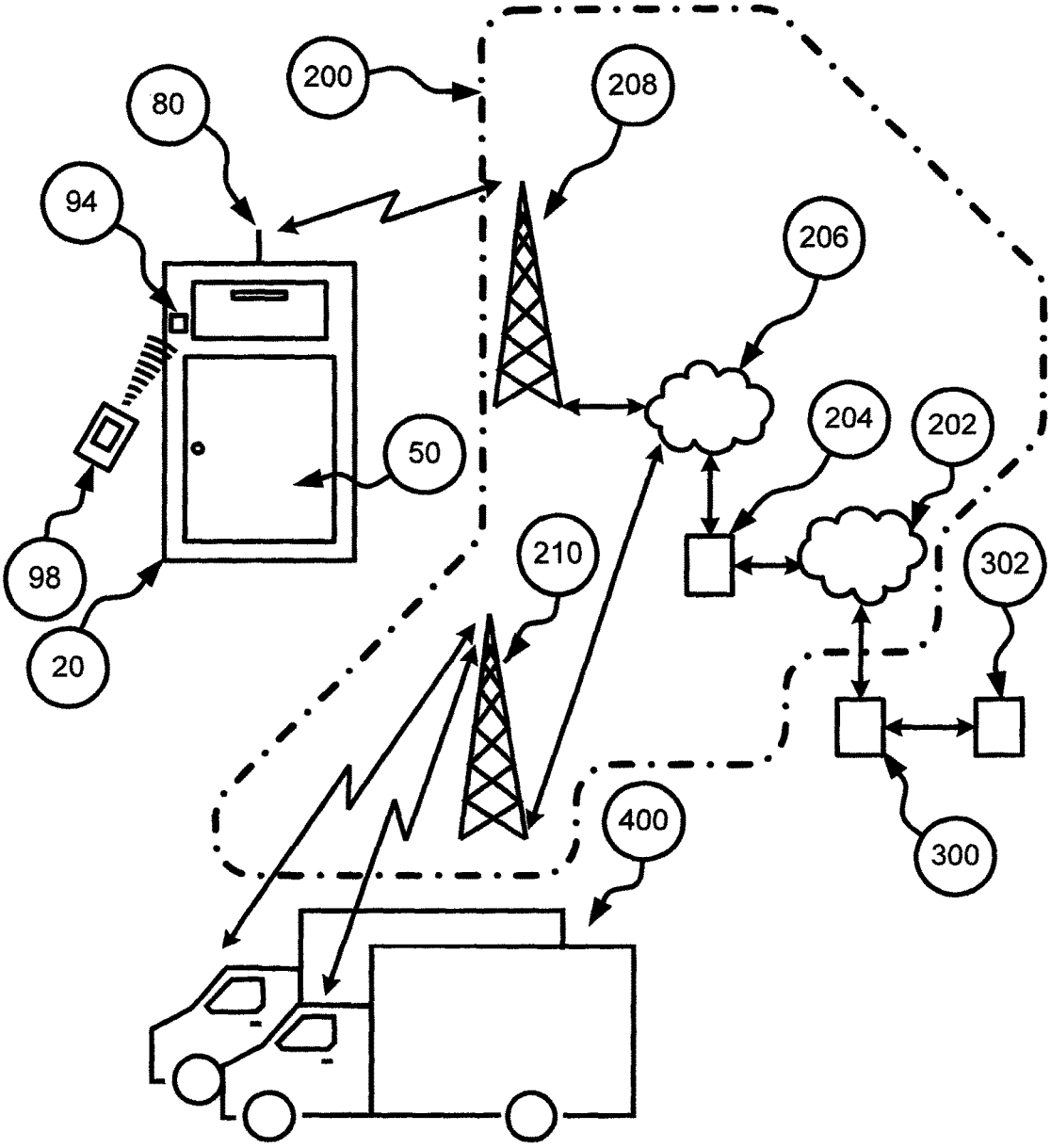
FIG. 4 is diagrammatic representation of a preferred embodiment of a type of network that can be used to communicate/intercommunicate between the operations center and the storage unit.
Figure 5:
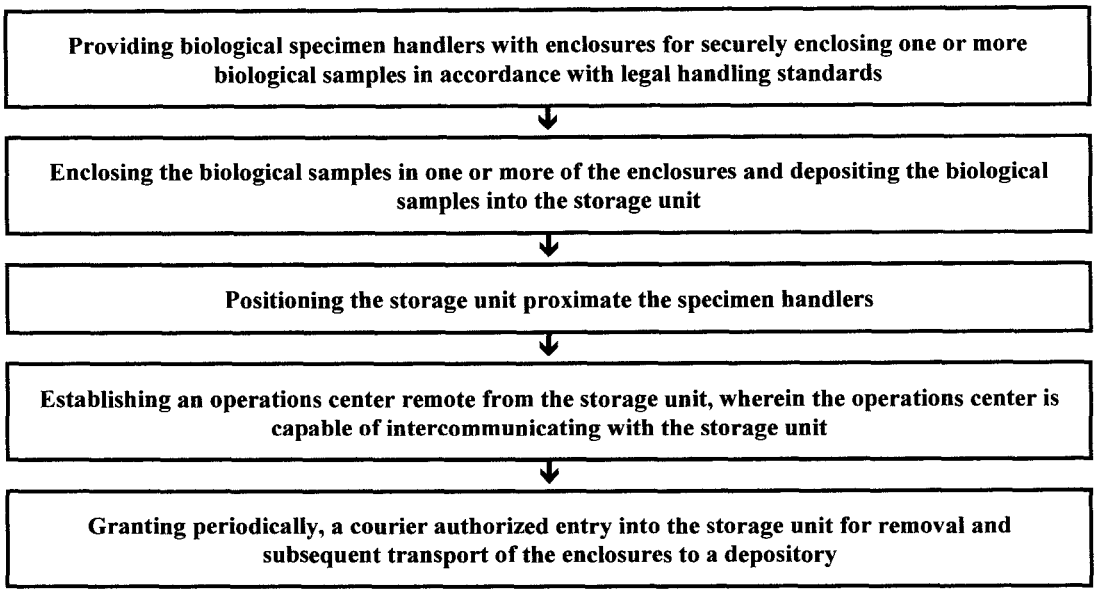
FIG. 5 is an illustration of the steps of a preferred embodiment of the present system and method.
Figure 6:
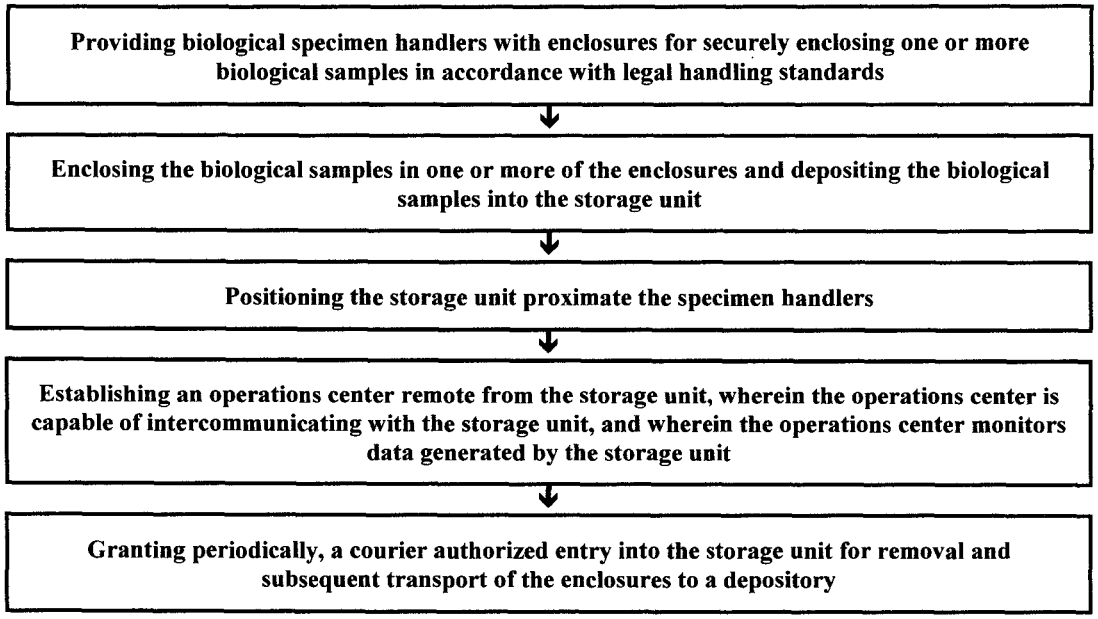
FIG. 6 is a depiction of the steps of another preferred embodiment of the present system and method.
Figure 7:
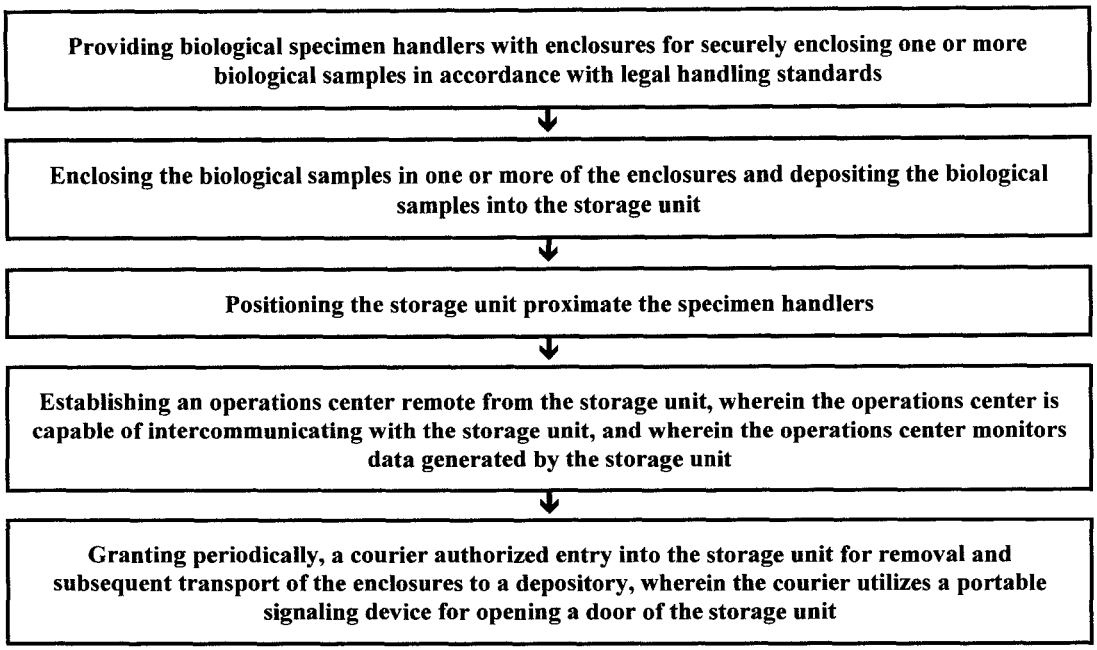
FIG. 7 is an exemplification of the steps of yet another preferred embodiment of the current system and method.
Figure 8:
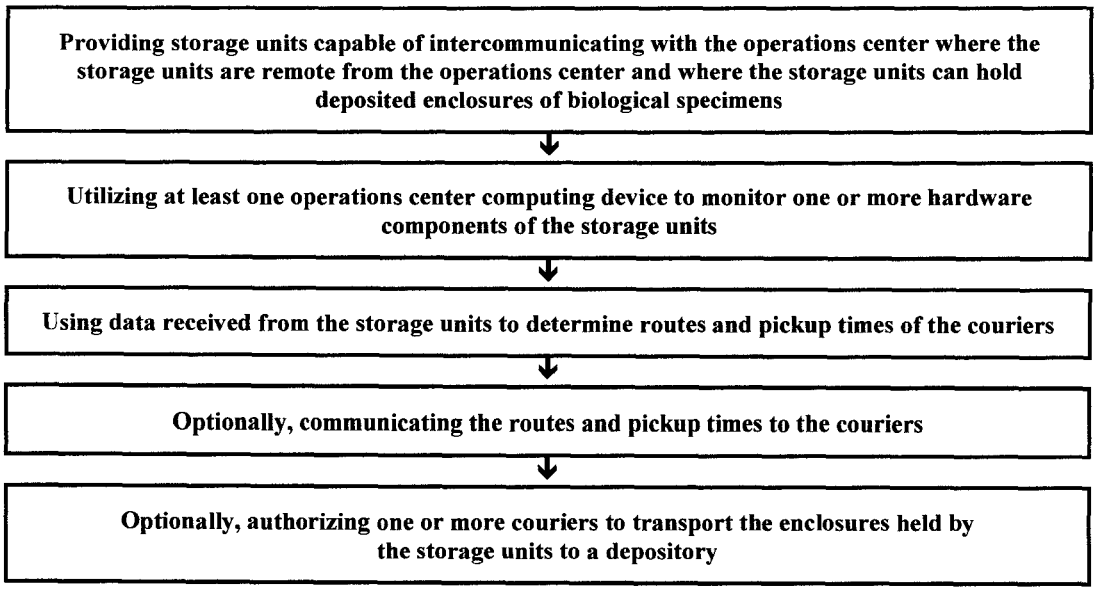
FIG. 8 is another illustration of the steps of a preferred embodiment of the present system and method.
Figure 9:
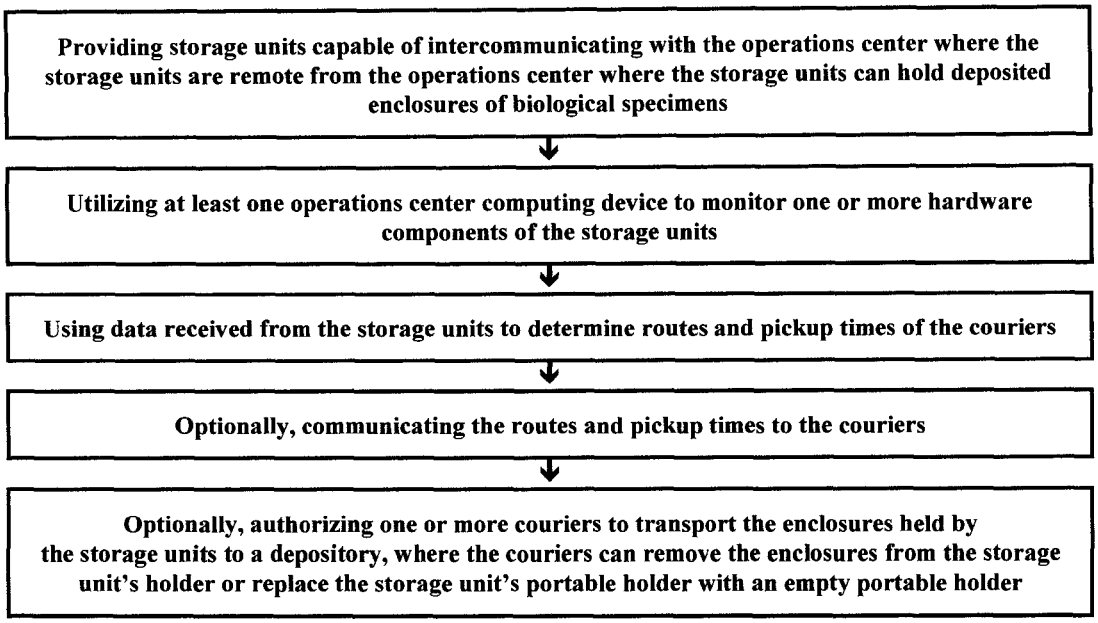
FIG. 9 is another exemplification of the steps of yet another preferred embodiment of the system and method.
Figure 10:
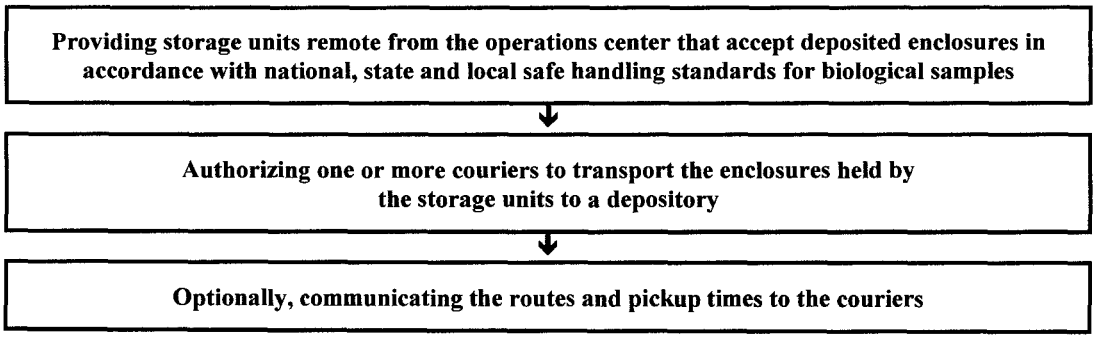
FIG. 10 is another depiction of the steps of another preferred embodiment of the system and method.
Figure 11:
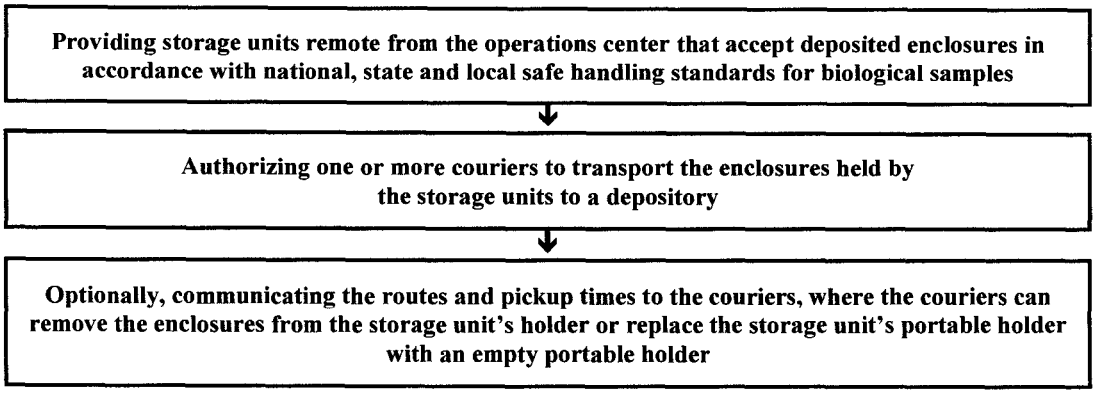
FIG. 11 is yet another illustration of the steps of a preferred embodiment of the present system and method.

FIG. 4 is diagrammatic representation of a preferred embodiment of a type of network (200) that can be used to communicate/intercommunicate between operations center (300) and storage unit (20), where operations center (300) is remote from storage unit (20). As shown, remote device (98) can be used to generate a door opening signal toward storage unit's (20) door opening signal receiver (94). In select preferred embodiments, operations center (300) provides one or more couriers operating vehicles (400) and remote devices (98) for unlocking door (50) of storage unit (20). Couriers for vehicles (400) are selected by the operations center (300), an employee, agent or another under the legal authority of the operations center (300). In accordance with the present invention, remote devices (98) utilize embedded key technology that corresponds to the CPU/transmitter's (150) embedded key or serial number. By utilizing network (200), operations center (300) can change the CPU/transmitter's (150) embedded key or serial number thereby altering a courier's admission parameters for storage unit (20).

As shown in FIG. 4, segments of network (200) can include WAN or public internet cloud (202), mobile network to WAN gateway (204), mobile network operator's or wireless service provider's infrastructure or cloud (206), transceiver station (208) proximate storage unit (20) and cellular base station (210) proximate vehicle (400). As previously indicated, operations center (300) is provided with at least one computing device (302), e.g., a server, for monitoring conditions, status and the environment of one or more of the secure storage units (20). Within the scope of the present invention, among other things, computing device (302) can monitor and log, time and quantity of deposits of enclosures into storage unit (20), internal temperature of storage unit (20), status of deposit-only gate (40) and door (50) and status of direct current energy source (82) and retrieval status of the deposited enclosures by the courier. In accordance with the present invention, operations center (300) can utilize the data received from the remote storage units (20) to determine movement and pickup times for the couriers operating vehicles (400) as well as lock/unlock door (50) when a courier is present at storage unit.

Figure 12:
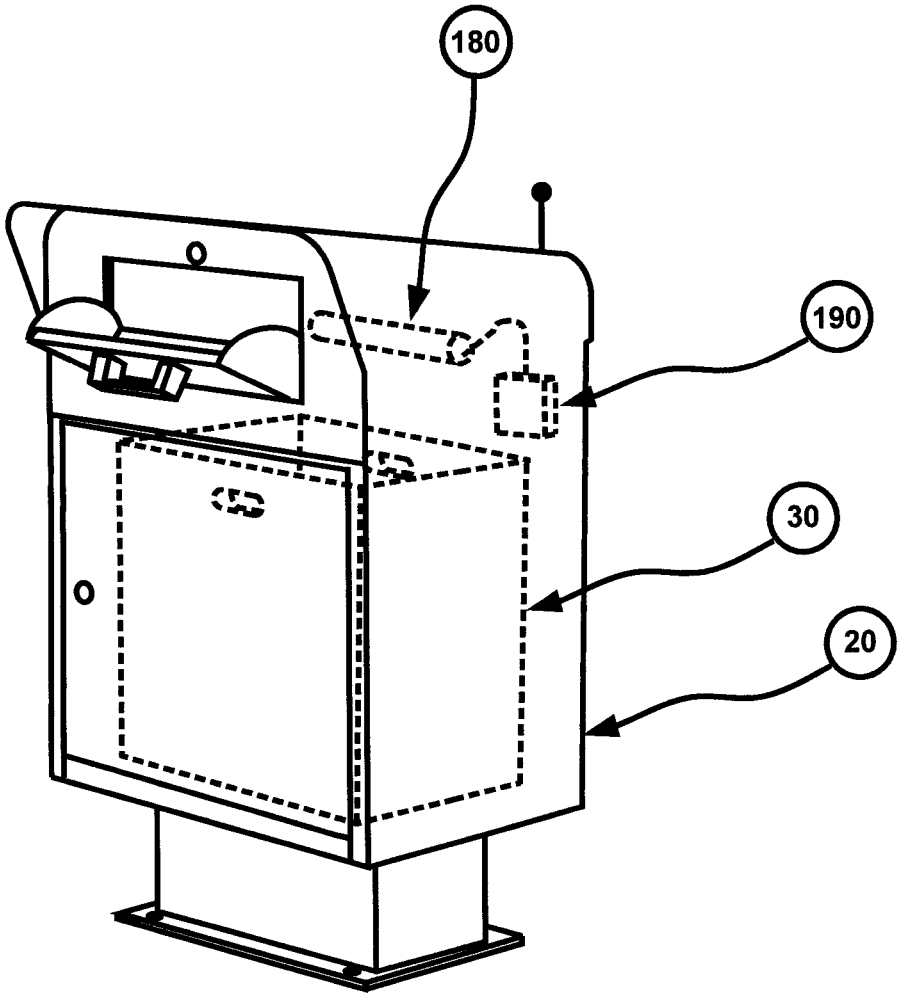
FIG. 12 is a lateral perspective of a preferred embodiment of storage unit including an ultraviolet light within the scope of the present invention.
Figure 13:
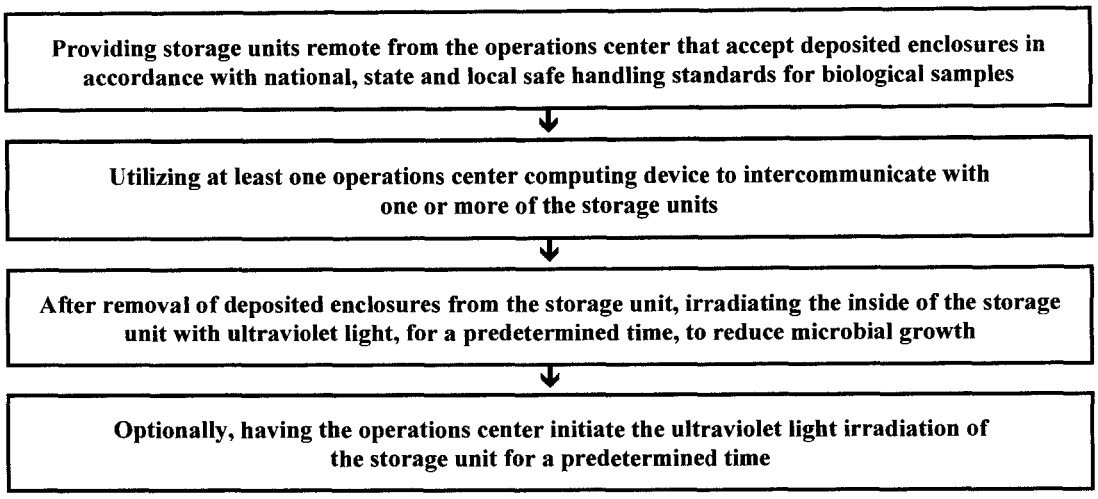
FIG. 13 is another illustration of the steps of a preferred embodiment of the present system and method.
Figure 14:
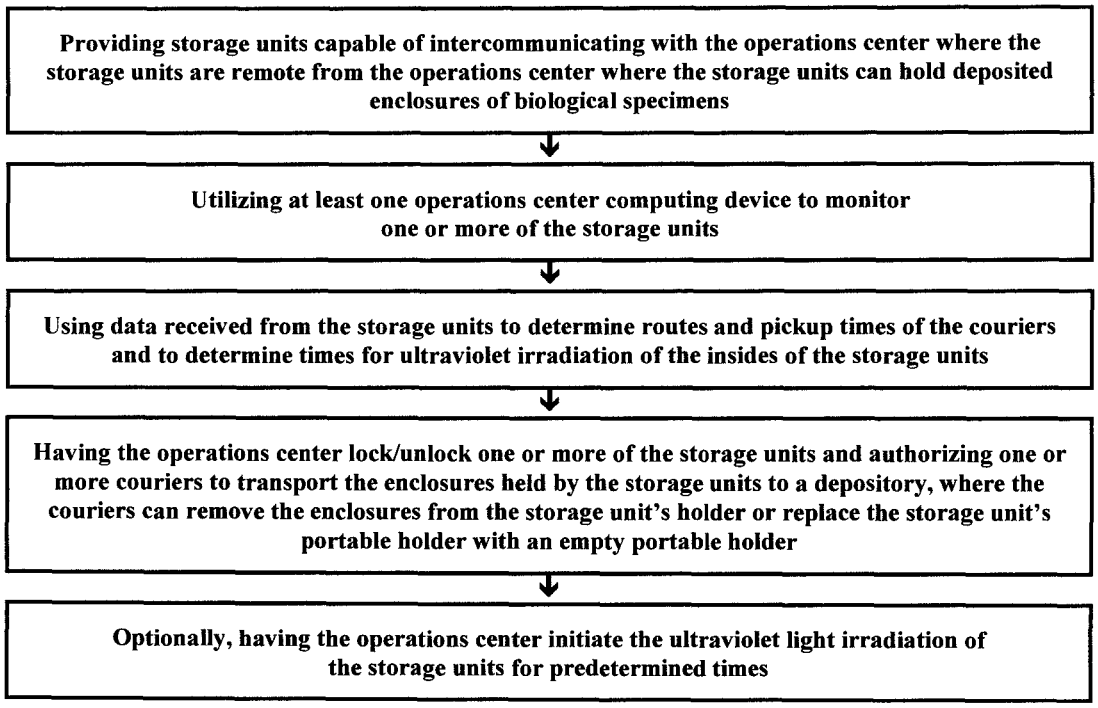
FIG. 14 is another exemplification of the steps of yet another preferred embodiment of the system and method.

A preferred embodiment of storage unit (20) is shown in FIG. 12. Ultraviolet light (180), ballast (190) and portable holder (30) are shown in phantom. Ballast (190) is connected with ultraviolet light (180) and can also be connected to direct current energy source (82) (not shown in this view). Within the scope of the present system, ultraviolet light (180) can be a low pressure/medium pressure mercury vapor arc or a LED. Ultraviolet light irradiation, having a wavelength of about 253 nanometers, is a germicide. For select preferred embodiments of the current system, when storage unit (20) is empty of deposited enclosures, ultraviolet light (180) is activated, for a predetermined time, to reduce microbial growth within storage unit (20). It is believed that the reduction of microbial growth decreases the possibility of cross contamination with the continued use of storage unit (20).

Select steps associated with the system and methods of practicing the present invention are depicted in FIGS. 5-11, 13 and 14.

Having disclosed the invention as required by Title 35 of the United States Code, Applicants now pray respectfully that Letters Patent be granted for their invention in accordance with the scope of the claims appended hereto.

What is claimed is:

1. A storage unit for securely holding one or more enclosures enclosing one or more biological specimens until said enclosures are removed from said storage unit for transport to a depository wherein subsequent analysis of said biological specimens can transpire; said storage unit comprising:

a) a lower section and an upper section, wherein said upper section comprises a pivotable deposit-only gate for receiving temporary deposits of said enclosures such that after deposit onto and closure of said pivotable deposit-only gate, said enclosures drops into said lower section;

b) a door and lock combination allowing removal of said enclosures from said storage unit;

c) a communications module;

d) one or more hardware components in communication with said communications module; said one or more hardware components selected from the group consisting of an enclosure detection sensor capable of detecting entry of said enclosures into said lower section, an internal temperature sensor, said door lock and lock combination comprising an energy source status monitor, an open/close sensor for said door, a door opening signal receiver, an electrically or manually actuated lock for said door, a gate movement sensor and/or a holder for temporarily holding said enclosures detector positioned about a lower section for detecting said holder;

e) an energy source; and f) an ultraviolet light positioned within said storage unit and operably connected to said door, wherein, when said storage unit does not contain any of said enclosures, and said door is closed, said ultraviolet light is activated, for a predetermined time, to reduce microbial growth.

2. The storage unit of claim 1, wherein said communications module is capable of communicating, via a network, with an operations center remote from said communications module.

3. The storage unit of claim 2 further comprising a photovoltaic panel.

4. The storage unit of claim 2, wherein said ultraviolet light has a wavelength of about 253 nanometers.

5. The storage unit of claim 4, wherein said holder comprises insulation.

6. The storage unit of claim 4 comprising:

a) a riser; or b) a vertical mounting apparatus; or c) a floor mounting apparatus.

7. A storage unit for securely holding one or more enclosures enclosing one or more biological specimens until said enclosures are removed from said storage unit for transport to a depository, wherein subsequent analysis of said biological specimens can transpire; said storage unit comprising:

a) a first section for receiving said one or more enclosures;

b) a door and lock combination allowing removal of said one or more enclosures from said storage unit;

c) a communications module in communication with an enclosure detection sensor capable of detecting entry of said one or more enclosures;

d) an energy source; and e) an ultraviolet light positioned within said storage unit and operably connected to said door, wherein, when said storage unit does not contain any of said enclosures, and said door is closed, said ultraviolet light is activated, for a predetermined time, to reduce microbial growth.

8. The storage unit of claim 7 comprising a second section and a deposit-only gate receiving temporary deposits of said enclosures prior to deposit into said first section.

9. The storage unit of claim 8 further comprising a holder for temporarily holding said enclosures, wherein said holder optionally comprises insulation.

10. The storage unit of claim 9, wherein said deposit-only gate is pivotable.

11. The storage unit of claim 8, wherein said communications module is in communication with one or more of the following: an energy source status monitor, an open/close sensor for said door, a door opening signal receiver, said door lock and lock combination comprising an electrically or manually actuated lock for said door, a gate movement sensor and/or a holder detector positioned about said first section for detecting a holder for temporarily holding said enclosures.

12. The storage unit of claim 11, wherein said communications module is capable of communicating, via a network, with an operations center remote from said communications module.

13. The storage unit of claim 12 further comprising a photovoltaic panel.

14. The storage unit of claim 13 comprising:

a) a riser; or b) a vertical mounting apparatus; or c) a floor mounting apparatus.

15. A storage unit for securely holding one or more enclosures enclosing one or more biological specimens until said enclosures are removed from said storage unit for transport to a depository; said storage unit comprising:

a) a first section for receiving one or more of said enclosures;

b) a door and lock combination allowing removal of said one or more enclosures from said storage unit;

c) an open/close sensor for said door;

d) an energy source; and e) an ultraviolet light positioned within said storage unit and operably connected to said door, wherein, when said storage unit does not contain any of said enclosures, and said door is closed, said ultraviolet light is activated to reduce microbial growth.

16. The storage unit of claim 15 comprising a second section and a deposit-only gate receiving temporary deposits of said enclosures prior to deposit into said first section.

17. The storage unit of claim 16 further comprising a holder for temporarily holding said enclosures, wherein said holder optionally comprises insulation.

18. The storage unit of claim 17, wherein said deposit-only gate is pivotable.

19. The storage unit of claim 18 comprising one or more hardware components in communication with a communications module; said one or more hardware components selected from the group consisting of an enclosure detection sensor capable of detecting entry of said enclosures into said first section, an internal temperature sensor, an energy source status monitor, said open/close sensor for said door, a door opening signal receiver, said door lock and lock combination comprising an electrically or manually actuated lock for said door, a gate sensor for movement of said opening and/or a holder detector positioned about said first section for detecting said holder.

20. The storage unit of claim 19, wherein said communications module is capable of communicating, via a network, with an operations center remote from said communications module.

21. The storage unit of claim 20 further comprising a photovoltaic panel.

22. The storage unit of claim 21 comprising:

a) a riser; or b) a vertical mounting apparatus; or c) a floor mounting apparatus.

* * * * *